US005332358A

United States Patent [19]

Hemmelgarn et al.

[11] Patent Number: 5,332,358

[45] Date of Patent: Jul. 26, 1994

[54] UNCOUPLED SEAL SUPPORT ASSEMBLY

[75] Inventors: Robert J. Hemmelgarn, Mason; Jeffrey A. Kress, Evendale; Richard W. Albrecht, Fairfield, all of Ohio

[73] Assignee: General Electric Company, Cincinnati, Ohio

[21] Appl. No.: 112,035

[22] Filed: Aug. 26, 1993

Related U.S. Application Data

[63] Continuation-in-part of Ser. No. 24,581, Mar. 1, 1993.

[51] Int. Cl.[5] ..... F01D 11/00

[52] U.S. Cl. ..... 415/174.5; 415/136; 415/174.1; 415/175; 415/177; 415/178; 29/525.1; 29/888.3; 29/888.02

[58] Field of Search ..... 415/115, 116, 134, 136, 415/138, 139, 170.1, 173.2, 173.1, 173.3, 173.4, 173.5, 173.7, 174.1, 174.4, 174.5, 175–178; 29/888, 888.02, 888.3, 525.1; 277/26, 53, 81 R, 84

[56] References Cited

U.S. PATENT DOCUMENTS 3,807,891 4/1974 McDow et al. .
4,397,471 8/1983 Feldman et al. ..... 415/115
4,554,789 11/1985 Napoli et al. ..... 415/116
5,143,512 9/1992 Corsmeier et al. ..... 415/115
5,154,575 10/1992 Bonner ..... 415/173.7
5,236,302 8/1993 Weisgerber et al. ..... 415/174.5

*Primary Examiner*—Edward K. Look
*Assistant Examiner*—Christopher Verdier
*Attorney, Agent, or Firm*—Jerome C. Squillaro; Nathan D. Herkamp

[57] ABSTRACT

A seal support assembly for a gas turbine engine includes a stator seal support having an annular seal backing extending axially away therefrom and having an integral retention flange at one end thereof. The retention flange includes a retention groove. An annular seal block is supported radially inwardly of the seal backing for cooperating with rotor seal teeth to define a fluid seal. A control ring is disposed radially outwardly of the seal backing and is supported thereby, with the control ring having a plurality of circumferentially spaced apart retention tabs cooperating with the retention flange for axially retaining the control ring on the seal backing. An annular heat shield is fixedly joined at one end to the seal support, and includes a plurality of circumferentially spaced apart retention tabs cooperating with the retention flange for axially retaining the heat shield to the seal backing while permitting unrestrained differential radial movement therebetween.

9 Claims, 5 Drawing Sheets

UNCOUPLED SEAL SUPPORT ASSEMBLY

This is a continuation-in-part of U.S. patent application Ser. No. 08/024,581 filed Mar. 1, 1993.

BACKGROUND OF THE INVENTION

The present invention relates to gas turbine engines and, more particularly, to aircraft-type high bypass ratio turbine engines having multi-stage compressor and turbine sections.

A typical modern gas turbine aircraft engine, particularly of the high bypass ratio type, includes multi-stage high pressure compressor and turbine sections interconnected by a central compressor shaft or, in some models, a forward shaft. In the later instance, the forward shaft extends between the webs of the last stage high pressure compressor disk and the first stage high pressure turbine disk webs. The high pressure turbine section typically includes first and second stage disks, and the compressor section includes a plurality of disks. Located at the radially outer end of each disk is a row of rotor blades which rotate adjacent to fixed stator vanes.

Stator seals are positioned in the combustor section of the engine, one adjacent to the last stage compressor stator, or outlet guide vanes, and one adjacent to the first stage turbine stator, or high pressure turbine nozzle. These high pressure stator seals are independent components often made of a low coefficient of expansion material or designed to include a closed cavity. These basic stator seal designs produce an adequate frequency margin, between the natural flexural vibration modes of seal components and corresponding seal rotor speed, however these types of designs result in larger than required thermal expansion clearances, since the stator vane and the rotor blades independently react to thermal conditions generated by the engine.

These undesirably large clearances are the result of thermal expansion mismatch of the stator and rotor structure during both transient and steady-state operation of the engine. During transient operation, the stator is influenced by relatively high heat transfer values, whereas the rotor bore is surrounded by lower values. These conditions cause the stator to expand significantly faster than the rotor. During steady-state operation of the engine, the rotor bore is bathed in temperatures much lower than the stator. This condition drives the stator to expand to, and remain at, a larger diameter which creates steady-state clearances larger than desired. Accordingly, there is a need for a stator seal design which minimizes thermal expansion and mismatch at both transient and steady-state operation of the engine, and a design which improves performance of the engine with improved thermal expansion clearance control between the rotor seal teeth and the stator seal.

SUMMARY OF THE INVENTION

A seal support assembly for a gas turbine engine includes a stator seal support having an annular seal backing extending axially away therefrom and having an integral retention flange at one end thereof. The retention flange includes a retention groove. An annular seal block is supported radially inwardly of the seal backing for cooperating with rotor seal teeth to define a fluid seal. A control ring is disposed radially outwardly of the seal backing and is supported thereby, with the control ring having a plurality of circumferentially spaced apart retention tabs cooperating with the retention flange for axially retaining the control ring on the seal backing. An annular heat shield is fixedly joined at one end to the seal support, and includes a plurality of circumferentially spaced apart retention tabs cooperating with the retention flange for axially retaining the heat shield to the seal backing while permitting unrestrained differential radial movement therebetween.

Brief Description of the Drawings

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
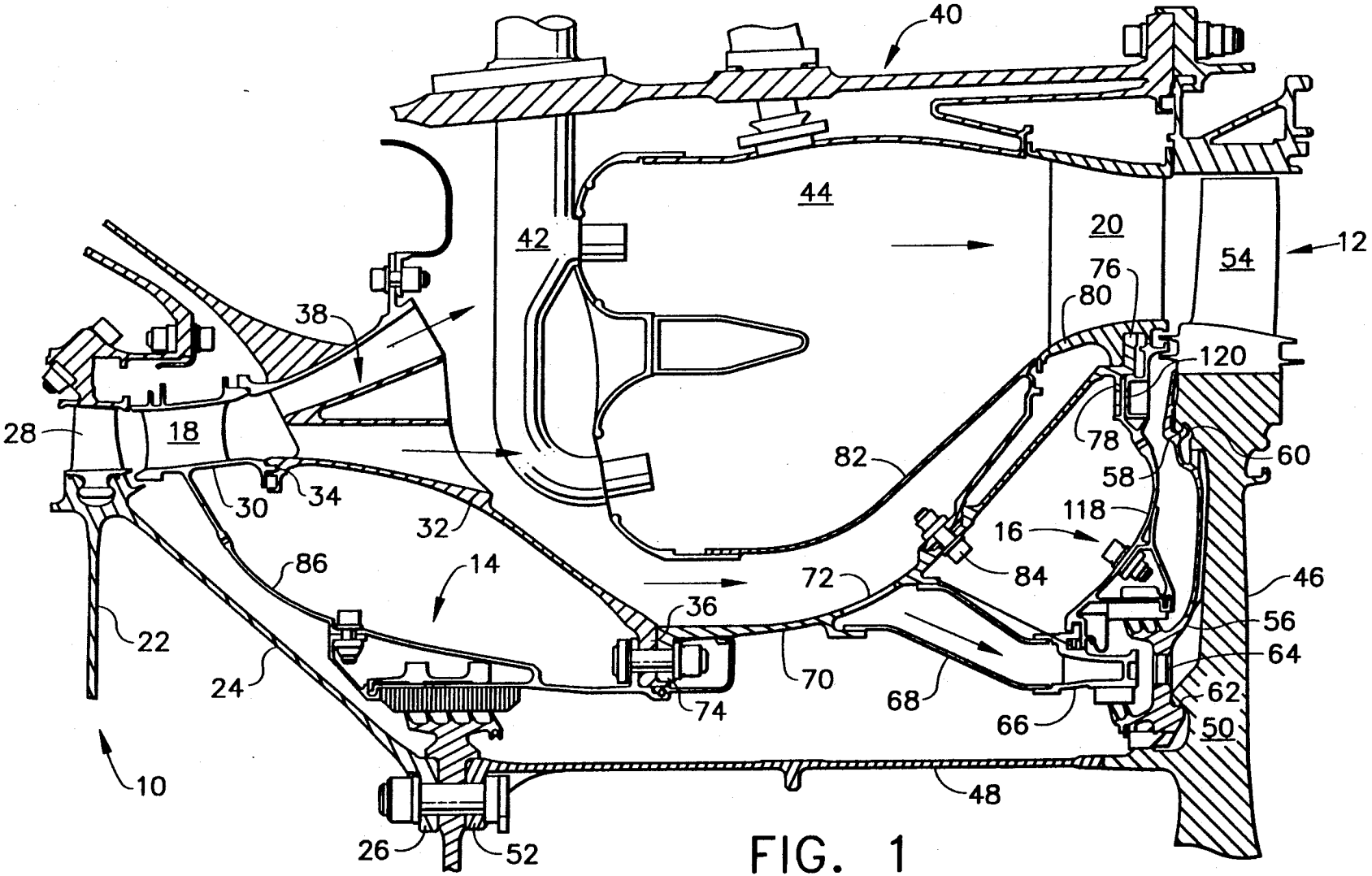
FIG. 1 is a schematic, side elevation of the combustor section of a gas turbine engine embodying the present invention.

As shown in FIG. 1, the present invention includes modifications to the high pressure compressor (HPC) section, generally designated 10, and high pressure turbine (HPT) section, generally designated 12, of an aircraft-type high bypass-ratio gas turbine engine. Specifically, the invention relates to a stator seal design 14 for the last stage stator or outlet guide vanes 18 in the compressor section 10, and a stator seal 16 for the first stage or high pressure turbine nozzle stator 20 in the turbine section 12.

The HPC 10 includes a last stage compressor disk 22 having a rearwardly extending cone 24 which terminates in a flange 26. Mounted in the radially outward end of the disk 22 is a row of rotor blades 28. Compressor stator 18 is welded to and supported by a first stator support 30 positioned along the lower surface of stator 18 and extends in an aft direction wherein it is connected to a second stator support 32 by a flanged connection 34. Stator support 32 terminates in an inwardly extending flange 36. Stator support 32 also supports combustor diffuser 38. Combustor diffuser 38 directs compressor air to the combustor 40 wherein it is mixed with fuel supplied by fuel nozzle 42 and ignited in the combustion chamber 44.

The HPT 12 includes a first stage disk 46 which includes a forward shaft 48 which is integral with disk web 50 and terminates in a downwardly extending flange 52. Torque generated by the HPT 12 is transmitted to the HPC 10 by the forward shaft 48.

Positioned on the radially outward end of first stage disk 46 are a plurality of rotor blades 54. A forward seal assembly 56 which includes a face plate 58 is connected to the first stage disk 50 by a bayonet connection 60 at a radially outer periphery and a bayonet connection 62 at a radially inner periphery. Seal assembly 56 includes a plurality of axial openings 64 adjacent to the inner periphery which receive cooling air from a stationary, multiple-orifice nozzle 66.

Nozzle 66 includes a forward extending housing 68 which is brazed to the stage-one high pressure nozzle support 70. Nozzle support 70 includes a hole 72 to direct air from the diffuser 38 into the nozzle housing 68.

Nozzle support 70 terminates in a forward direction in a downwardly extending flange 74, and in a rearward direction in an outwardly extending flange 76 and a downwardly extending flange 78. Outward extending flange 76 is adjacent stator support 80 which is brazed to the lower surface of turbine nozzle 20. Nozzle support 70 is also bolted above hole 72 to combustor inner support 82 by bolts 84.

Figure 2:
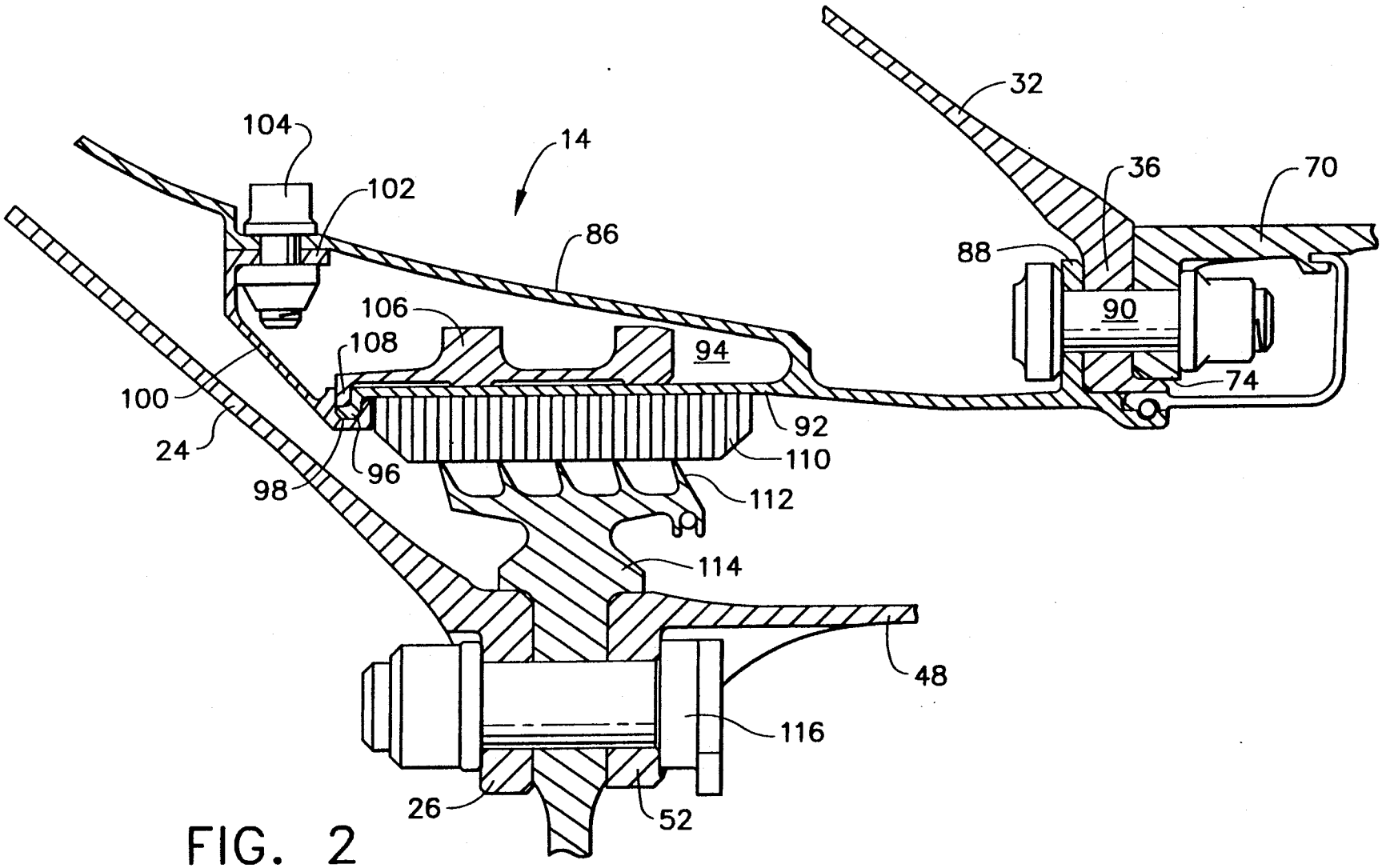
FIG. 2 is a detail of the engine of FIG. 1 showing the stator seal for the last stage compressor stator.

As shown in FIG. 2, stator seal design 14 for compressor stator 18 includes seal support member 86 extending inwardly and rearwardly from stator support 30. Seal member 86 can be made integral with stator support 30 by welding the components together. Seal member 86 terminates in a rearward direction in an outwardly extending flange 88 which is bolted to flange 36 of stator support 32 and flange 74 of nozzle support 70 by bolts 90. Seal member 86 also includes a forwardly extending annular seal backing in the form of a cylindrical arm 92 located below seal member 86 for forming a cavity 94.

Forward arm 92 terminates in a downwardly extending flange 96 which is located in a channel or groove 98 formed in retainer section 100. On the opposite end of retainer section 100 is a flange 102 which is bolted to seal member 86 by bolts 104. Retainer section 100 seals the cavity 94, forming a dead air space.

Stator seal design 14 also includes a controlled-expansion ring, or simply control ring 106 positioned on forward arm 92 within cavity 94. Control ring 106 is aligned within cavity 94 by a downwardly extending flange 108 which is positioned in groove 98 of retainer piece 100. Control ring 106 is made of a material having a low coefficient of thermal expansion such as Inconel Alloy 909, or Titanium Aluminide; however, any suitable material having a low coefficient of thermal expansion to withstand temperatures up to 760° C. (1400° F.) would be satisfactory.

A honeycomb seal block 110 is positioned below forward arm 92 and above seal teeth 112 of rotor disk 114. Rotor disk 114 is bolted between flange 26 of cone 24 and flange 52 of forward shaft 48 by bolts 116.

Figure 3:
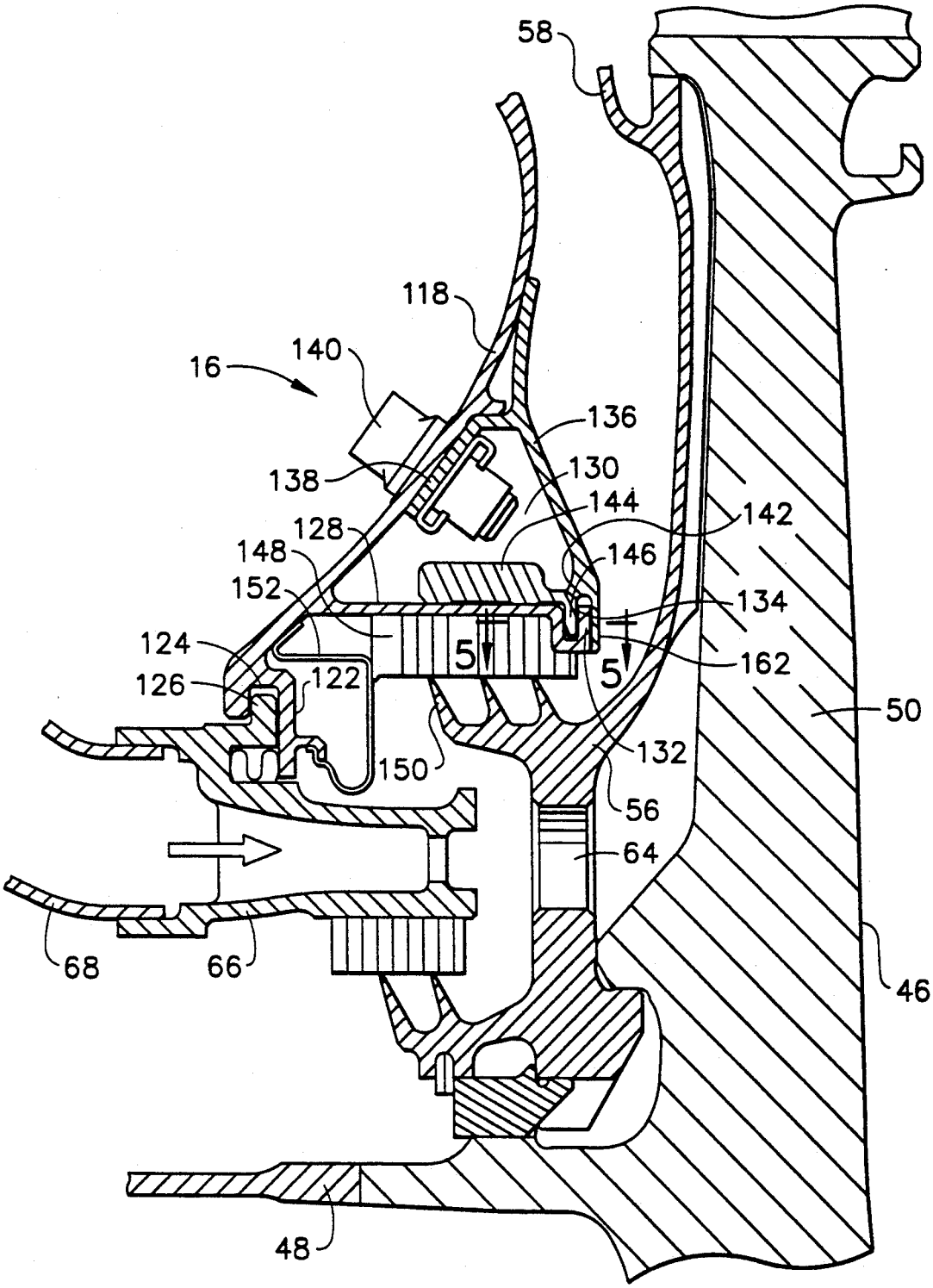
FIG. 3 is a detail of the engine of FIG. 1 showing the stator seal for the first stage turbine stator.

As shown in FIG. 3, the stator seal design 16 for turbine nozzle 20 includes a seal support member 118 which extends radially outwardly and terminates in a flange 120 (FIG. 1) positioned adjacent nozzle support flange 78. Seal support 118 terminates in a downwardly extending flange 122 which forms a channel 124 for receiving a radially outward extending flange 126 from nozzle 66. Seal support 118 includes an annular seal backing in the form of a cylindrical aft arm 128 which extends axially away from the seal support 118 at its radially inner end and forms a cavity 130. Seal backing 128 terminates at its aft end in a retention flange or hook 132 which forms a retention channel or groove 134 facing radially outwardly.

A combination aft heat shield and retainer 136 includes a forward flange 138 at a radially outer end fixedly joined to the seal support 118 by bolts 140, and a plurality of radially inwardly extending retention tabs 142 for attachment with retention flange 132. Retainer section 136 shields cavity 130 and forms a dead air space. Located within cavity 130 is a low coefficient of thermal expansion, controlled-expansion ring, or simply control ring 144 positioned in an interference fit on the radial outward surface of the seal backing 128 and supported thereby. Control ring 144 includes a plurality of radially inwardly extending retention tabs 146 which extend into channel 134 for positioning of the control ring 144.

Located radially inwardly of the aft arm 128 and supported thereby is an annular honeycomb seal block 148 conventionally brazed thereto. Seal block 148 is also positioned above labyrinth seal teeth 150 extending radially outwardly from seal assembly 56. Honeycomb block 148 is positioned axially between aft arm flange 132 and a forward heat shield 152.

Stator seal designs 14, 16 improve the engine performance by controlling the clearance between the rotor seal teeth 112, 150 and the stator seal blocks 110, 148 due to thermal expansion. The design controls clearance by isolating deflections of the stator seals 14, 16 from their surrounding environment. Because the control rings 106, 144 possess a lower coefficient of thermal expansion than forward arm 92 and aft arm 128 of seal members 86, 118 respectively, at steady-state operation of the engine the control rings force the seal members down to a smaller diameter. The honeycomb blocks 110, 148 are preferably designed to have a larger thickness, at least two to three times the thickness of previous honeycomb blocks, to isolate the forward arm 48 and aft arm 128 respectively from the very high heat transfer values generated by the engine.

Seal members 86, 118 provide a relatively long shells of revolution which isolate the critical sealing areas from deflections of the stator supports 36, 80, and dissipate or attenuate the deflections rapidly along the length of the seal members. The dead air space created in cavities 94, 130 creates low heat transfer values on the control rings 106, 144 which slows thermal growth. The radial box section formed by seal members 86, 118 and retainer sections 100, 136 provide enhanced torsional stiffness of the seal to provide dimensional and vibrational stability.

Additionally, the control rings 106, 144 are removable from cavities 94, 130 so that control rings having different coefficients of thermal expansion or different thermal masses can be substituted to vary clearance values between the stators and rotors if desired.

Since the heat shield 136 is a relatively thin annular member as compared to the control ring 144 it will respond more quickly to changes in temperature and therefore radially expand and contract at a different rate than that of the control ring 144 and the seal backing 128 constrained thereby. Accordingly, it is desirable to uncouple expansion and contraction movement between the fast-responding heat shield 136 and the retention flange 132.

Figure 4:
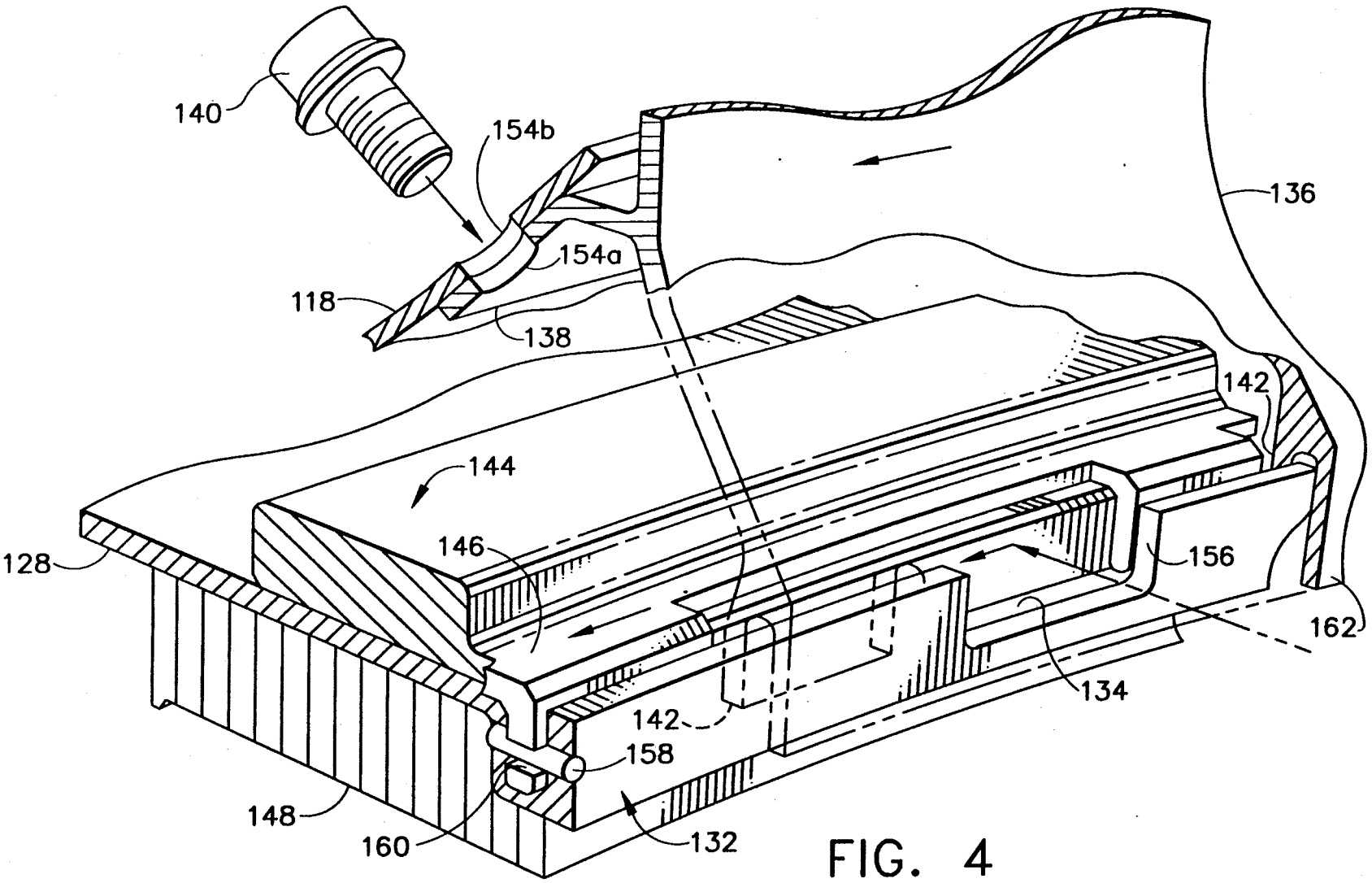
FIG. 4 is an enlarged, perspective view, partly in phantom, of the seal support assembly illustrated in FIG. 3.
Figure 5:
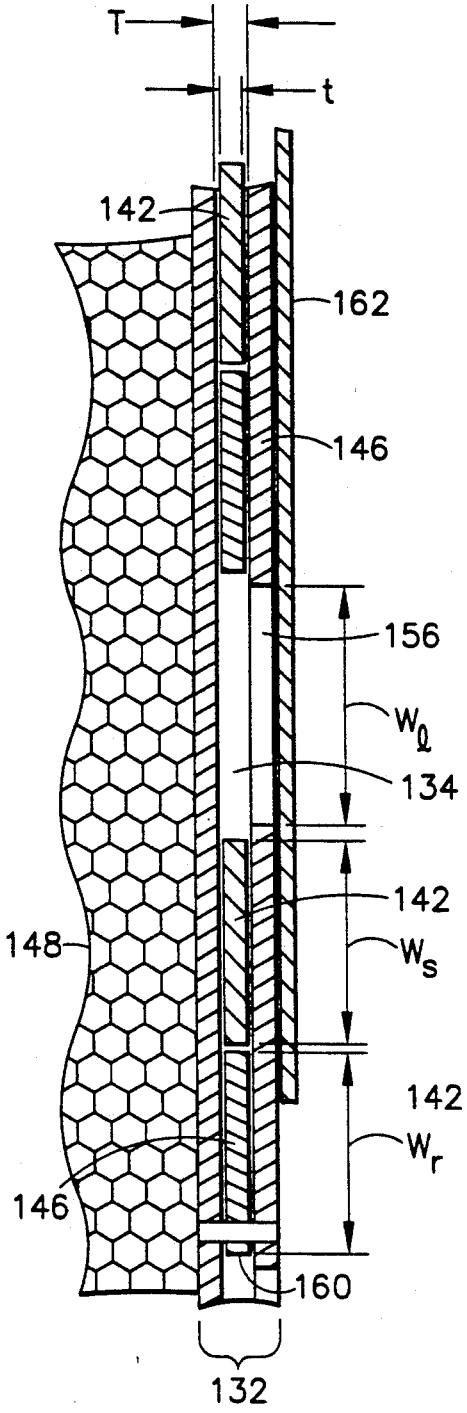
FIG. 5 is a sectional view through a portion of the seal support assembly illustrated in FIG. 3 and taken along line 5—5.

FIGS. 4 and 5 illustrate in more particularity the connection between the heat shield 136 and the retention flange 132 which uncouples these members to ensure that thermal deflection of the honeycomb block 148 forming the seal with the rotor teeth 150 (of FIG. 3) is independent of the heat shield thermal deflection. In the embodiment illustrated in FIGS. 4 and 5, the retaining ring tabs 146 extend radially inwardly from the aft end of the control ring 144 and are preferably equally circumferentially spaced apart from each other and cooperate with the retention flange 132 for axially retaining the control ring 144 on the seal backing 128 without radial restraint therebetween. Since the control ring 144 is preferably disposed in a conventional interference fit on the seal backing 128, it is subject to thermal ratcheting due to slip forces created by axial temperature gradients in the control ring 144 and the seal backing 128 during operation. The ring retention tabs 146 are trapped in the retention groove 134 between the legs of the retention flange 132 and thereby prevent unrestrained axial movement of the control ring 144. The ring tabs 146 are made as small as practical and positioned closely adjacent to the main body of the control ring 144 to minimize stresses therein due to the reaction forces with the retention flange 132.

As shown in FIG. 4, the forward flange 138 at the forward end of the heat shield 136 includes a plurality of circumferentially spaced apart holes 154*a* which are aligned with a respective plurality of holes 154*b* in the seal support 118 through which the respective bolts 140 are inserted and fastened with their respective nuts for fixedly joining the heat shield 136 to the seal support 118. At the radially inner end of the heat shield 136 is the plurality of radially inwardly extending and preferably equally circumferentially spaced apart retention tabs 142 which also cooperate with the retention flange 132 for axially retaining the heat shield 136 at its inner end to the seal backing 128 while permitting unrestrained and uncoupled differential radial movement therebetween.

The retention flange 132 includes a plurality of circumferentially spaced apart scallops or loading slots 156 in the aft end or leg thereof for providing axial access to the retention groove 134. In the exemplary embodiment illustrated in FIGS. 4 and 5, the number of shield tabs 142, ring tabs 146, and loading slots 156 are equal to each other, for example twenty, and the circumferential spacing or pitch thereof is substantially equal to each other. Each of the loading slots 156 has a circumferential width $W_l$, and the ring tabs 146 are sized with a smaller circumferential width $W_r$ for allowing the control ring 144 to be assembled on the seal backing 128 with the ring tabs 146 being axially translated through respective ones of the loading slots 156 as illustrated by the loading arrows in FIG. 4. Similarly, the shield tabs 142 have circumferential widths $W_s$ sized smaller than the width $W_l$ of the loading slots 156 for allowing the heat shield 136 to be joined to the retention flange 132 with the shield tabs 142 being axially translated through respective ones of the loading slots 156.

The method of assembling the stator seal assembly illustrated in FIG. 4 initially includes the steps of axially translating the control ring 144 to position the ring tabs 146 through respective ones of the loading slots 156 and into the retention groove 134. The control ring 144 is then moved into final position by rotating the control ring 144, in the counterclockwise direction illustrated in FIG. 4 for example, to move the ring tabs 146 in the retention groove 134 and away from the loading slots 156. In the exemplary embodiment illustrated in FIG. 4, a single cylindrical stop pin 158 is conventionally fixedly joined through the forward and aft legs of the retention flange 132 and axially bridges the retention groove 134 at a single location. The control ring 144 may therefore be rotated counterclockwise until one of the ring tabs 146 circumferentially abuts the stop pin 158 which prevents further tangential or circumferential movement thereof in the counterclockwise direction beyond the stop pin 158.

As shown in FIG. 5, the retention groove 134 has an axial thickness T, and the shield tabs 142 and ring tabs 146 have equal axial thicknesses t which are suitably less than the thickness T of the retention groove 134 for allowing both the ring tabs 146 as described above, and the shield tabs 142 to be rotated circumferentially in the retention groove 134 during assembly.

Similarly, the heat shield 136 is assembled to the retention flange 132 by axially translating the heat shield 136 to position the shield tabs 142 through respective ones of the loading slots 156 and into the retention groove 134 along the same path as that of the ring tabs 146 and illustrated by the loading arrows in FIG. 4. The heat shield 136 is moved into final position by rotating the heat shield 136 counterclockwise to move the shield tabs 142 away from the loading slots 156 and into abutting contact with respective ones of the ring tabs 146. At this location, the respective holes 154*a* and 154*b* are aligned with each other so that the several bolts 140 may be inserted therethrough for securing the forward flange 138 to the seal support 118. The ring tabs 146 are then captured between the stop pin 158, which prevents unrestrained counterclockwise movement thereof, and the shield tabs 142, which prevent unrestrained clockwise movement thereof.

Accordingly, both the shield tabs 142 and the ring tabs 146 are disposed in the retention groove 134 axially between the forward and aft legs of the retention flange 132 and circumferentially away from the loading slots 156 so that the heat shield 136 and the control ring 144 are axially retained in the retention groove 134. Since the shield and ring tabs 142, 146 are disposed in a tongue-and-groove arrangement with the retention groove 134, they are radially slidable therein without restraint. In this way, both the control ring 144 and the heat shield 136 are unrestrained by their respective tabs 146, 142 in the radial direction. Since the heat shield 136 is fast-responding to temperature changes, it is thusly allowed to freely expand and contract without interference which could adversely affect the position of the seal block 148 and degrade the sealing effectiveness thereof with its cooperating seal teeth 150.

In the exemplary embodiment illustrated in FIGS. 4 and 5, one of the ring tabs 146 includes a tangentially facing indentation 160 sized for fully receiving the stop pin 158. In this way, all of the ring tabs 146 may be identical in size and equally spaced apart to maximize their circumferential width $W_r$ which is preferably equal to the circumferential width $W_s$ of the shield tabs 142 and slightly less than the width $W_l$ of the loading slot 156. The aft leg of the retention flange 132 between adjacent ones of the loading slots 156 may therefore have a circumferential width substantially equal to the combined widths of one of the ring tabs 146 and one of the shield tabs 142 axially hidden and retained thereby.

In the preferred embodiment illustrated in FIGS. 3-5, the heat shield 136 further includes an imperforate, annular windage cover 162 integrally joined to the inner end thereof and axially spaced from the shield tabs 142 to define a generally U-shaped groove therebetween. The windage cover 162 is disposed adjacent to the aft leg of the retention flange 132 for covering the retention flange 132 and the loading slots 156 therein to reduce aerodynamic losses as air flows thereover during operation due to rotation of the forward seal assembly 56 shown in FIG. 3.

Accordingly, the stator seal assembly disclosed above allows readily easy assembly and disassembly of the control ring 144 and the heat shield 136 from the seal backing 128, which also improves inspection capability and maintainability. The design provides both axial and tangential restraints for the control ring 144 to prevent thermal ratcheting. The design also provides axial and tangential restraints for the heat shield 136 to limit shield deflections caused by temperature differences between the shield and its supporting structure. The design is also compact since the ring tabs 146 and the shield tabs 142 share the retention flange 132. This is particularly important in designs having axial space restrictions due to relatively close positioning of adjacent components. The design also provides a smooth boundary effected by the heat shield 136 and its windage cover 162 for reducing aerodynamic losses. And, most significantly, the design radially decouples the seal block 148 from the heat shield 136 by providing the radial sliding joint between the shield tabs 142 and the retention flange 132.

Figure 6:
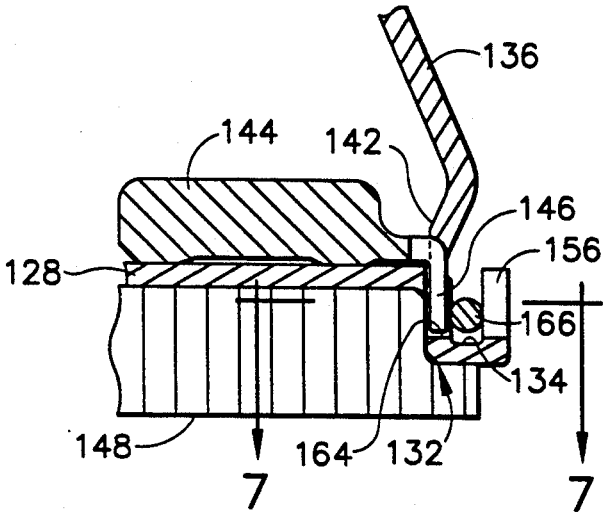
FIG. 6 is a radial, partly sectional view of a portion of the stator seal assembly in accordance with an alternate embodiment of the present invention.
Figure 7:
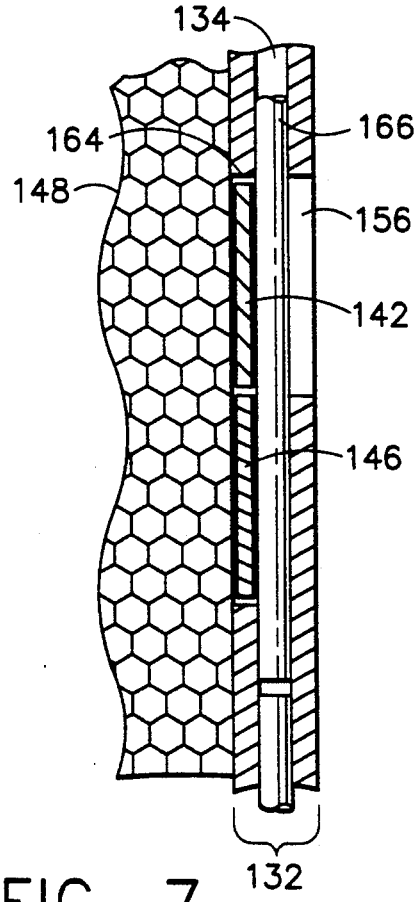
FIG. 7 is a partly sectional view of the seal support assembly illustrated in FIG. 6 and taken along line 7—7.

FIGS. 6 and 7 illustrate an alternate embodiment of the present invention wherein the loading slots 156 are again in the aft leg of the retention flange 132, and the forward leg thereof further includes a plurality of circumferentially spaced apart retention slots 164 circumferentially aligned at least in part with respective ones of the loading slots 156 for receiving both the ring tabs 146 and the shield tabs 142 for retention therein. In this way, the shield and ring tabs 142, 146 are circumferentially aligned and restrained in the retention slots 164, and are axially retained therein by a circumferentially split retention ring 166 disposed in the retention groove 134 between the forward and aft legs of the retention flange 132.

Although the invention has been described with respect to the aft stator seal 16 it may also be used for the forward stator seal 14.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A gas turbine engine seal support assembly comprising:

a stator seal support;

an annular seal backing extending axially away from said seal support and having an integral retention flange at one end thereof, said retention flange having a radially outwardly facing retention groove;

an annular seal block supported radially inwardly of said seal backing for defining with rotor seal teeth positionable adjacent thereto a seal for restricting fluid flow therebetween;

a control ring disposed radially outwardly of said seal backing and supported thereby, said control ring having at one end thereof a plurality of radially inwardly extending and circumferentially spaced apart retention tabs cooperating with said retention flange for axially retaining said control ring on said seal backing; and an annular heat shield fixedly joined at one end to said seal support, and having at a radially inner end a plurality of radially inwardly extending and circumferentially spaced apart retention tabs cooperating with said retention flange for axially retaining said heat shield to said seal backing while permitting unrestrained differential radial movement therebetween.

2. An assembly according to claim 1 wherein:

said retention flange includes a plurality of circumferentially spaced apart loading slots in one end thereof for providing access to said retention groove; and said circumferential spacing of said loading slots, said ring tabs, and said shield tabs are substantially equal to each other, and said ring tabs are sized for allowing said control ring to be assembled on said seal backing with said ring tabs being axially translated through respective ones of said loading slots, and said shield tabs are sized for allowing said heat shield to be joined to said retention flange with said shield tabs being axially translated through respective ones of said loading slots.

3. An assembly according to claim 2 wherein said retention groove has an axial thickness, and said shield tabs and said ring tabs have axial thicknesses less than said retention groove thickness for allowing said shield tabs and said ring tabs to be rotated circumferentially in said retention groove during assembly.

4. An assembly according to claim 3 wherein said shield tabs and said ring tabs are disposed in said retention groove circumferentially away from said loading slots so that said heat shield and said control ring are axially retained in said retention groove, with said shield tabs and said ring tabs being radially slidable in said retention groove.

5. An assembly according to claim 4 further including a tangential stop pin fixedly joined to said retention flange in said retention groove for circumferentially abutting one of said ring tabs to prevent rotation of said control ring beyond said stop pin.

6. An assembly according to claim 5 wherein said heat shield further comprises an imperforate, annular windage cover integrally joined to said inner end thereof and axially spaced from said shield tabs, said windage cover being disposed adjacent to said retention flange for covering said retention flange and said loading slot therein.

7. An assembly according to claim 6 wherein said stop pin is cylindrical, and one of said ring tabs includes an indentation sized for receiving said stop pin.

8. A method of assembling said stator seal assembly of claim 6 comprising:

axially translating said control ring to position said ring tabs through respective ones of said loading slots and into said retention groove;

rotating said control ring to move said ring tabs away from said loading slots until one of said ring tabs abuts said stop pin;

axially translating said heat shield to position said shield tabs through respective ones of said loading slots and into said retention groove; and rotating said heat shield to move said shield tabs away from said loading slots and into abutting contact with respective ones of said ring tabs.

9. An assembly according to claim 2 wherein said retention flange further includes first and second legs defining therebetween said retention groove, with said loading slots being disposed in said first leg, and said second leg having a plurality of circumferentially spaced apart retention slots circumferentially aligned at least in part with respective ones of said loading slots for receiving both said ring tabs and said shield tabs for retention therein; and further comprising:

a circumferentially split retention ring disposed in said retention groove between said first and second legs for axially retaining said shield tabs and said ring tabs in said retention slots.

* * * * *